US005425388A

United States Patent [19]

Chen et al.

[11] Patent Number: 5,425,388

[45] Date of Patent: Jun. 20, 1995

[54] TELESCOPIC SAFETY UMBRELLA CASE

[76] Inventors: Tsung-Cheng Chen; Tsung-Tai Chen, both of 2F., No. 22, Alley 80, Lane 39, Section 1, Shi Pai Road, Taipei, Taiwan, Prov. of China

[21] Appl. No.: 194,579

[22] Filed: Feb. 10, 1994

[51] Int. Cl.[6] ..... A45B 15/00

[52] U.S. Cl. ..... 135/34.2; 135/48

[58] Field of Search ..... 135/34.2, 37, 44, 48

[56] References Cited

U.S. PATENT DOCUMENTS

| | | | |
|---|---|---|---|
| 141,151 | 7/1873 | Lusby | 135/48 |
| 337,146 | 3/1886 | Ghezzi | 135/48 |
| 3,809,107 | 5/1974 | Liu | 135/48 |
| 4,703,768 | 11/1987 | Lee | 135/48 |
| 5,135,017 | 8/1992 | Fujiyama | 135/34.2 |
| 5,161,560 | 11/1992 | Sheu | 135/48 X |
| 5,195,550 | 3/1993 | Chan | 135/48 |

FOREIGN PATENT DOCUMENTS 2126803 10/1989 Japan .

*Primary Examiner*—Lanna Mai
*Attorney, Agent, or Firm*—Bacon & Thomas

[57] ABSTRACT

A telescopic umbrella case which possesses water-collecting function and light-reflecting effect for enhancing the safety of a user when walking at night. The umbrella case is composed of an innermost top sleeve member and several subsidiary sleeve members which are telescopically assembled and able to be extended into an elongated state for entirely covering an umbrella. A resilient water-draining valve is disposed at a top end of the first sleeve member. The water-draining valve includes a valve rod and a valve body. The valve rod is pressable against the ground to push the valve body away from a water-draining hole of the top sleeve member, permitting the rain water collected therein to flow through the water-draining hole down onto the ground. The sleeve members are directly molded from light-reflecting material or are painted with reflective paint or attached with reflective paper or printed with fine figures, so that the umbrella case is indicative of the user at night and thus the safety of the user is greatly enhanced when walking at night. On the outer surface of each sleeve member is disposed several longitudinal projecting ribs for preventing the reflective material on the outer surface of the sleeve member from being scraped during frequent telescopic movement thereof and for enhancing the fitting tightness between respective sleeve members.

6 Claims, 8 Drawing Sheets

FIG. 6
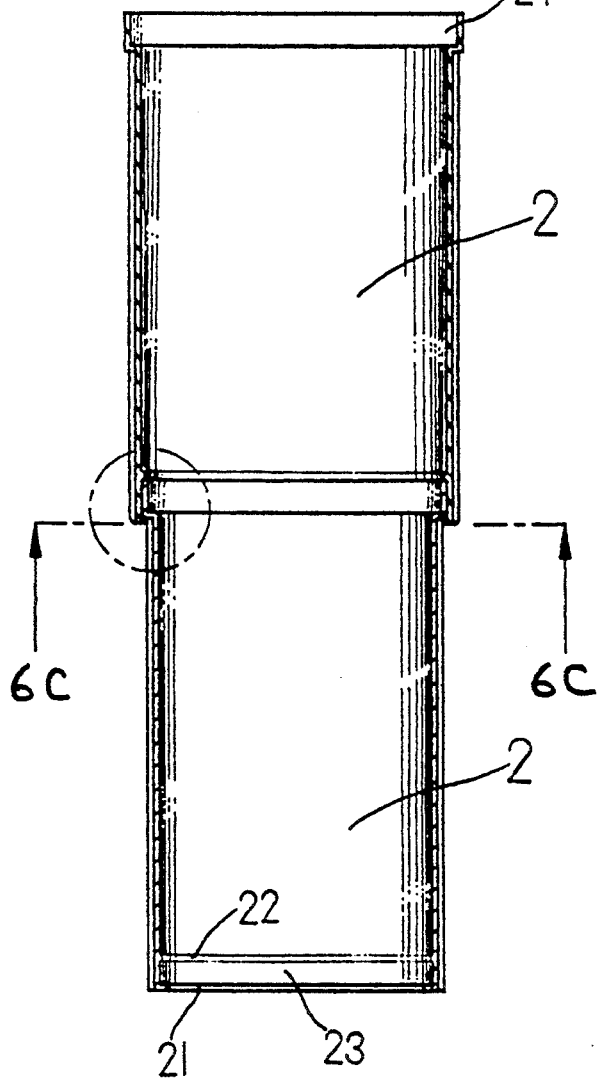
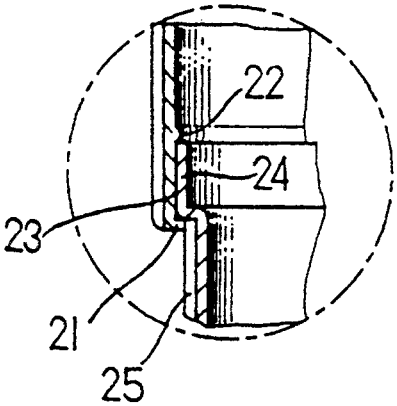
FIG. 6A
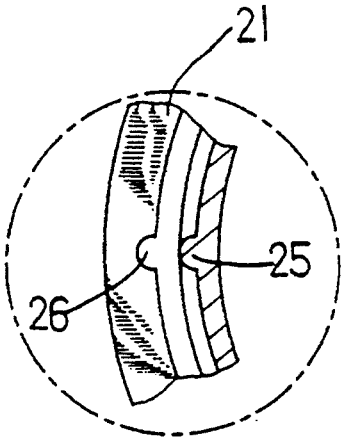
FIG. 6B
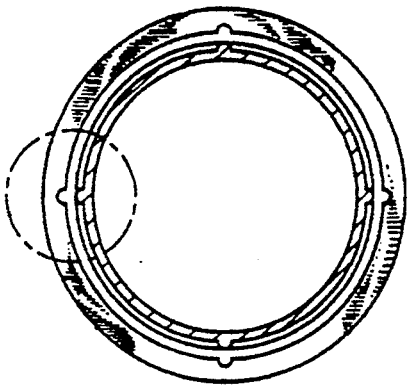
FIG. 6C

TELESCOPIC SAFETY UMBRELLA CASE

BACKGROUND OF THE INVENTION

The present invention relates to a telescopic safety umbrella case, and more particularly to a telescopic umbrella case which can collect water and reflect light for ensuring the safety when walking at night.

It often takes place that when a person holding an umbrella enters a public place such as a bus, a restaurant, a store, etc., the rain water attaching to the umbrella is very likely to wet or even contaminate a carpet or clothes of others. This always causes much inconvenience to general public.

A conventional waterproof umbrella case has been developed to solve the above problem. This conventional umbrella case is mainly composed of several sleeve members which have different inner diameters and are telescopically connected with one another by means of ring members. Such umbrella case is characterized in that a first sleeve member has a conic extreme end which can cooperate with different types of fitting plugs according to different shapes of umbrella tips to form a close water-collecting receptacle. In addition, a water-guiding means is fitted between the first and second sleeve members. The water-guiding means is integrally molded, having an inner funnel-shaped loop and an outer loop. The outer surface of the outer loop is formed with channels in which a waterproof fastening member is disposed. The inner and outer loops are interruptedly connected, defining a clearance which serves as a water-guiding channel for guiding and collecting the rain drops on the surface of the umbrella into the first and second sleeve members. By means of the waterproof fastening member in the channel of the first sleeve member, the second sleeve member can serve as a water-collecting container when necessary so as to prevent the rain water from leaking out through the joint fissure.

Although the above conventional umbrella case has the function of collecting rain water and avoiding contamination of the carpet or clothes caused by the rain water attaching to the umbrella, there still are several shortcomings existing in the conventional device as follows:

(1) While possessing the water-collecting function, the conventional umbrella case is not provided with a water-draining valve. The rain water collected in the sleeve member can be only drained by means of raising the umbrella to a certain angle relative to the ground and discharging the water from the original water-collecting channel. Accordingly, in case a user raises and stretches the umbrella full of the rain water in a crowded public place, the rain water will still splash to the people around. Moreover, most ladies have the habit of using the umbrella in a shining day for shading the sun light. When they stretch the umbrella, the rain water will splash around to wet others and cause embarrassing situation. Therefore, the lacking of water-draining structure of the conventional umbrella case is unsatisfactory.

(2) The structure of the conventional umbrella case is complicated and has no light-reflecting effect. Therefore, when walking at night, the user is not easy to be seen by a driver of a fast running car. This is dangerous.

In view of the above, it is necessary to provide an improved umbrella case to eliminate the aforesaid shortcomings.

SUMMARY OF THE INVENTION

It is therefore a primary object of the present invention to provide a telescopic safety umbrella case composed of a top sleeve member and several subsidiary sleeve members. This umbrella case not only possesses the conventional rain water-collecting function but also includes a pressable water-draining valve, whereby a user only needs to press the water-draining valve against the ground for draining out the rain water collected in the umbrella case onto the ground. Therefore, the conventional shortcoming of splashing the collected rain water onto others can be eliminated.

It is a further object of the present invention to provide the above umbrella case which is made of reflective material or is painted with a layer of reflective material or is attached with a reflective paper, so that the umbrella case is indicative of the user walking at night to ensure the safety of the user. In addition, the sleeve members of the umbrella case are provided with several projecting ribs which make the respective sleeve members more closely fitted on one another and avoid abrasion of the reflective material disposed on the surface of the umbrella case due to the frequent telescopic movement thereof. Moreover, the surface of the umbrella case can be printed with fine figures to enhance the appearance thereof.

It is still a further object of the present invention to provide the above umbrella case which is designed with simple structure and components so that the manufacturing cost thereof is reduced.

According to the above objects, the umbrella case of the present invention is composed of an innermost top sleeve member and several subsidiary sleeve members which are telescopically assembled. The diameters of the subsidiary sleeve members are gradually increased from inner side to outer side, whereby the sleeve members are able to be extended into an elongated state for entirely covering an umbrella or retracted into a shortened multi-layered assembly which has reduced volume and is suitable to be directly secured at a tip of the umbrella without intervening stretching movement thereof. The characters of the present umbrella case reside in that a resilient water-draining valve is disposed at a top end of the top sleeve member, including a valve rod and a leakproof valve body. The valve body is normally urged by a spring and located at a closing position to seal a water-draining hole of the top sleeve member and avoid leaking of the rain water collected therein. When a user wants to discharge the rain water collected in the umbrella case, he/she only needs to press the valve rod of the water-draining valve against the ground to overcome the resilient force of the spring and push the valve body away from the water-draining hole, permitting the rain water collected in the top sleeve member to flow through the water-draining hole down onto the ground. In addition, the sleeve members are directly molded from light-reflecting material or are painted with reflective paint or attached with reflective paper, so that the umbrella case is indicative of the user at night and thus the safety of the user is greatly enhanced when walking at night. On outer surface of each subsidiary sleeve member is disposed several longitudinal projecting ribs for preventing the reflective material on the outer surface of the sleeve member from being scraped during frequent telescopic movement thereof and for enhancing the fitting tightness between respective sleeve members.

The present invention can be best understood through the following description and accompanying drawings, wherein:

BRIEF DESCRIPTION OF THE DRAWINGS

FIG. 6 shows the fitting structure of the subsidiary sleeve members of present invention:

FIG. 6A is an enlarged view showing the engagement of the stepped projection within the groove of adjacent subsidiary sleeve members;

FIG. 6B is an enlarged view showing a longitudinal rib and corresponding recess of adjacent subsidiary sleeve members;

FIG. 6C is a cross sectional view taken along the line *6c—6c* of FIG. 6;

DETAILED DESCRIPTION OF THE PREFERRED EMBODIMENT

Figure 1:
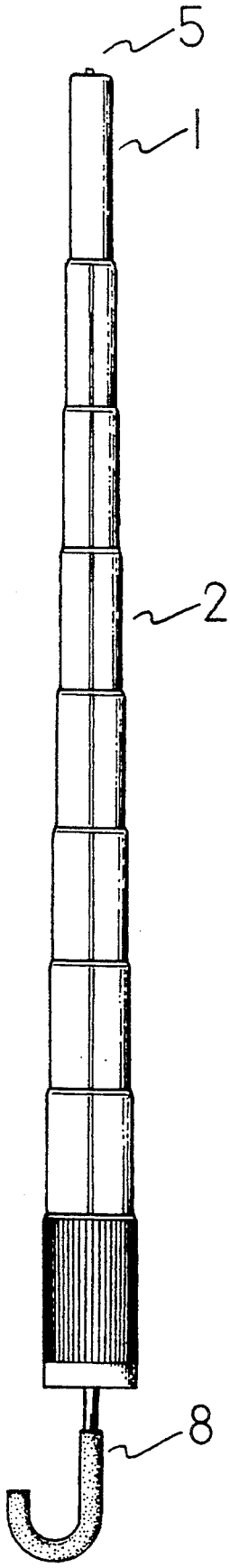
FIG. 1 is a plane view showing that the umbrella case of the present invention is extended to fully cover an umbrella.
Figure 2:
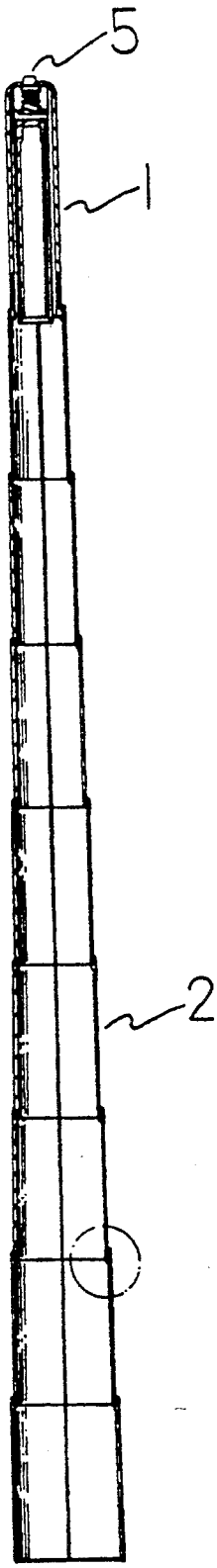
FIG. 2A is an enlarged view of two adjacent subsidiary sleeves members in an extended state; umbrella case in an extended state.
Figure 2A:
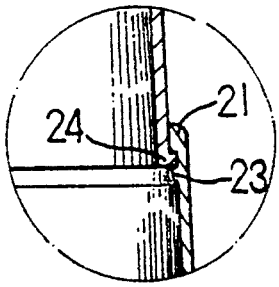
Figure 3:
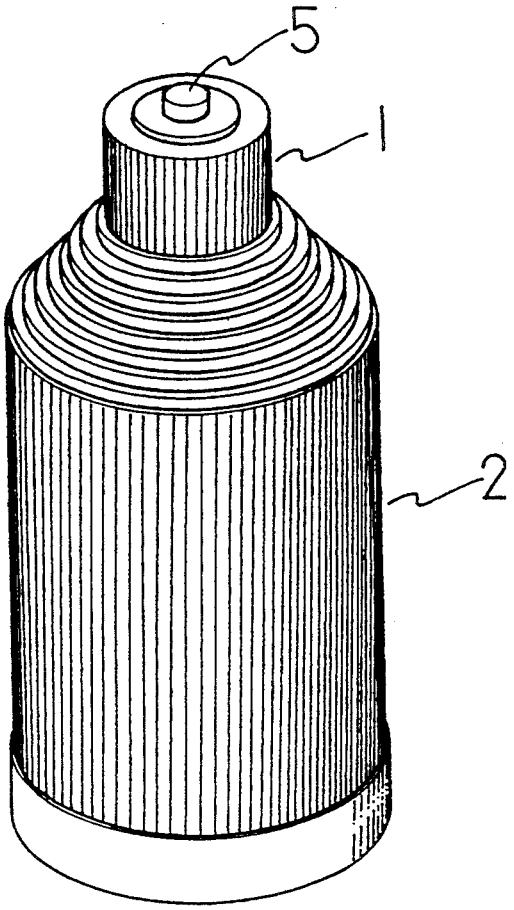
FIG. 3 is a perspective view of the present umbrella case in a contracted state.
Figure 4:
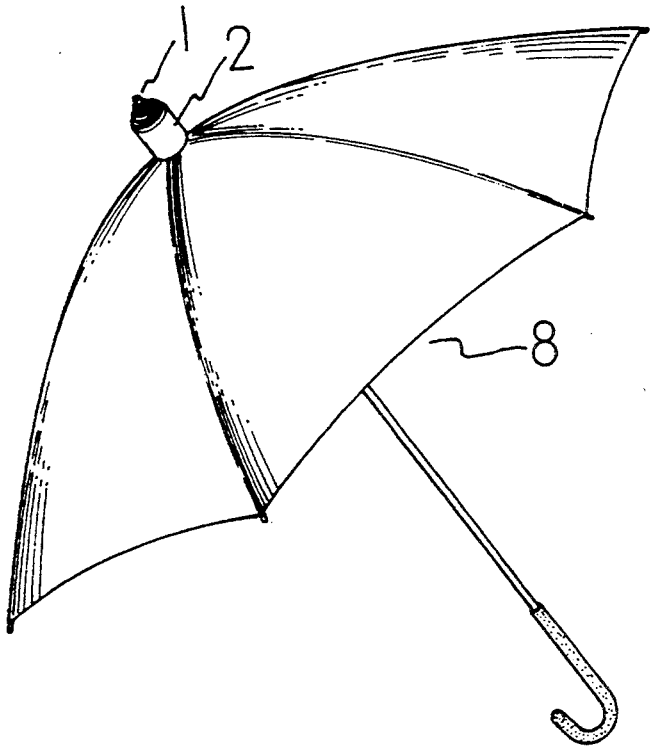
FIG. 4 is a perspective view showing that the umbrella case is contracted to a minimum length and secured at a tip of a stretched umbrella.

Please refer to FIGS. 1 to 6. The telescopic safety umbrella case of the present invention is composed of an innermost top sleeve member 1 and several subsidiary sleeve members 2 which are telescopically assembled. The diameters of the subsidiary sleeve members 2 are gradually increased from inner side to outer side, whereby the assembled sleeve members 8 can be extended to form an umbrella case for entirely covering an umbrella (as shown in FIGS. 1 and 2). Alternatively, the top sleeve member 1 and subsidiary sleeve members 2 can be retracted into one another to form a contracted multi-layered assembly with reduced volume (as shown in FIG. 3). The contracted assembly can be directly secured at a tip of the umbrella without interrupting the stretching movement thereof (as shown in FIG. 4).

Figure 5:
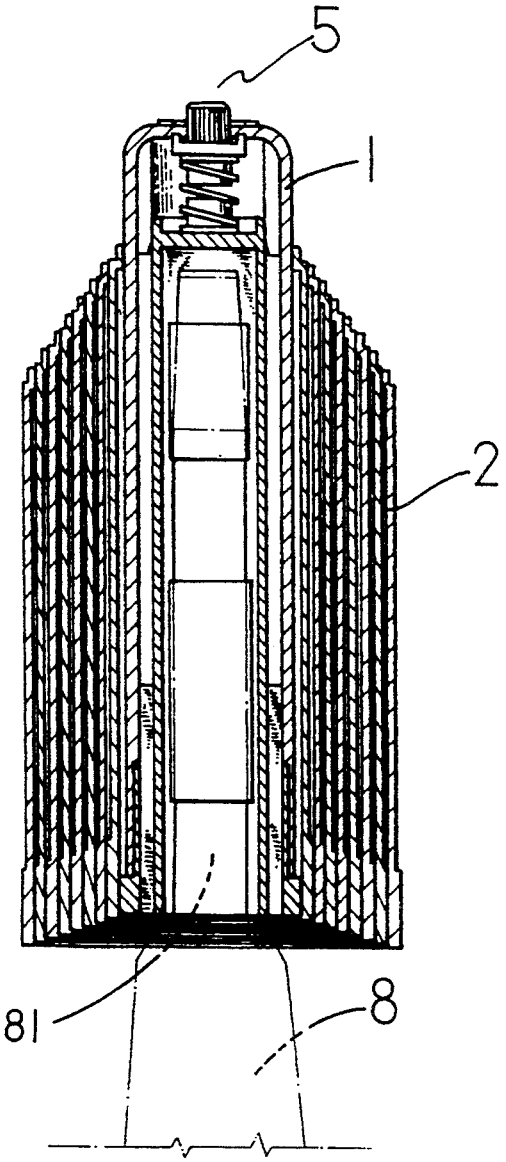
FIG. 5 is a sectional view of the present umbrella case in a contracted state.
Figure 7:
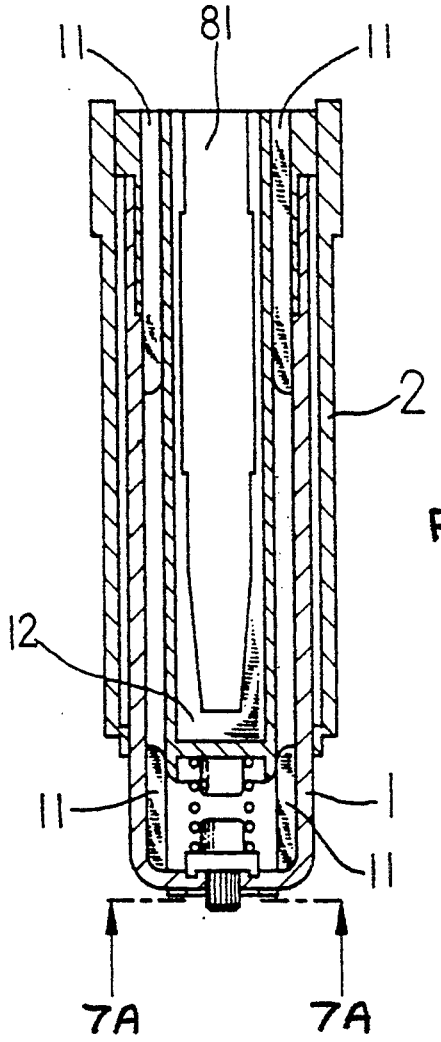
FIG. 7 shows the structure of the resilient water-draining valve of the present invention.
Figure 7A:
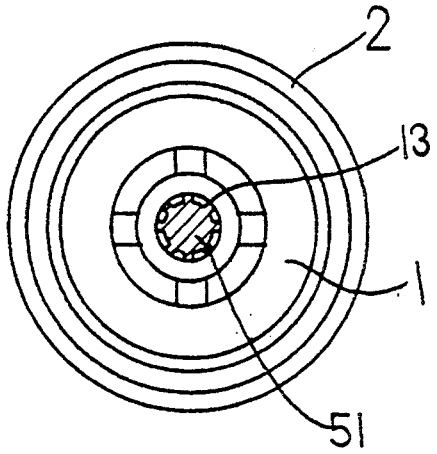
FIG. 7A is a cross sectional view taken along the line 7A—7A of FIG. 7.
Figure 8:
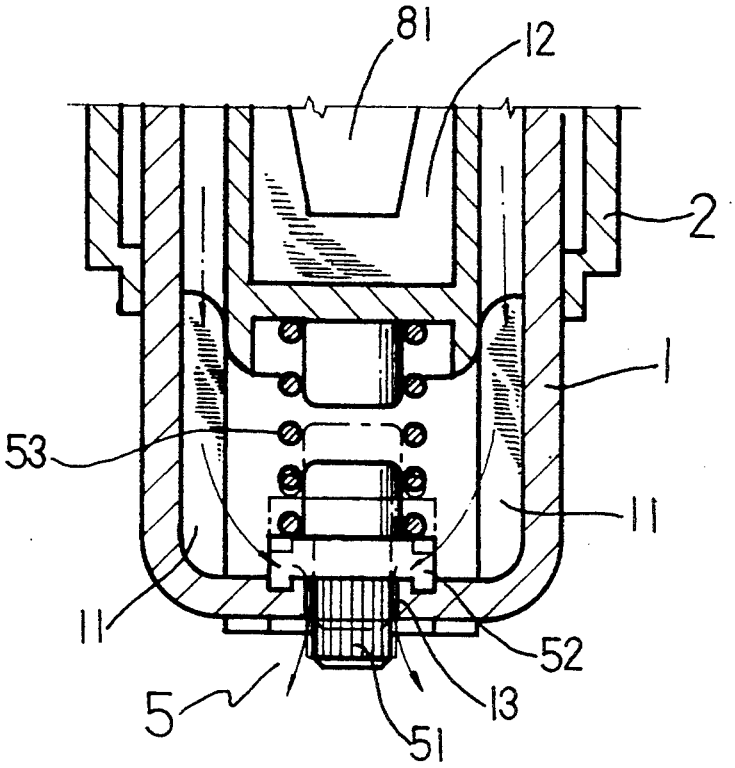
FIG. 8 shows the draining movement of the resilient water-draining valve of the present invention.

Please refer to FIGS. 5, 7 and 8. The innermost top sleeve member 1 is substantially a double-layered member defined by an outer wall and an inner wall. The double layers of the top sleeve member 1 define a water-collecting receptacle 11 by the outer wall and an inner space 12 by the inner wall, the latter totally receiving the tip 81 of the umbrella 8 so that the present umbrella case is integrally associated with the umbrella 8 without the necessity of separating from each other. A resilient water-draining valve structure 5 is disposed at a top end of the top sleeve member 1, including a valve rod 51 and a valve body 52. The valve rod 51 extends through a water-draining hole 13 of the top sleeve member 1 and partially protrudes beyond the top sleeve member 1. The valve body 52 is made of soft leakproof material such as rubber for closing the water-draining hole 13. At normal time, the valve body 52 is biased by the resilient force of a spring 53 and is located at a position for closing the water-draining hole 13 and avoiding leaking of the rain water collected in the water-collecting receptacle 11. On the other hand, when the user wishes to discharge the rain water in the water-collecting receptacle 11, he/she only needs to press the outward protruding valve rod 51 of the water-draining valve 5 against the ground to overcome the resilient force of the spring 53 and push the valve body 52 away from the closing position. As a result, the rain water collected in the receptacle 11 will flow through the water-draining hole 13 down onto the ground. Such procedure is very quick and convenient while the shortcoming of splashing rain water onto others during discharging the rainwater can be eliminated.

Please not refer to FIGS. 5 and 6. The top sleeve member 1 and the subsidiary sleeve members 2 are directly molded from light-reflecting material or are painted with reflective paint or attached with reflective paper so that the umbrella case indicates the user at night and thus the safety of the user holding the umbrella can be greatly enhanced when walking at night. When the user wants to stretch the umbrella for use, the umbrella case must be shortened into a contracted state as shown in FIG. 3. When the user goes indoors, after retracting the umbrella, he/she can extend the umbrella case to totally cover the umbrella as shown in FIG. 1 so as to prevent splashing of the rainwater. Accordingly, such frequent relative telescopic movement of the sleeve members is very liable to scrape and damage the reflective material disposed on the surfaces of the sleeve members, causing scratches thereon and forming an undesirable appearance. Moreover, such scratches may make the umbrella case lose its light-reflecting function. For avoiding the aforesaid problem, the fitting structures between respective sleeve members are improved in the present invention, wherein the subsidiary sleeve members 2 are structurally identical while the diameters thereof are dimensionally different. Each subsidiary sleeve member 2 is truncately conic tube-shaped with gradually increasing inner and outer diameters. A front end of the subsidiary sleeve member 2 is formed with an inward bent flange section 21 and an annular projection 22 spaced from the flange section 21 by a certain distance. The flange section 21 and the annular projection 22 define an annular fixing groove 23 therebetween. A rear end of the subsidiary sleeve member 2 is formed with a stepped ring section 24 for engaging with the annular fixing groove 23. In addition, on the outer surface of each subsidiary sleeve member 2 are disposed several longitudinal projecting ribs 25 and the flange section 21 is formed with corresponding guiding recesses 26 so that the respective subsidiary sleeve members 2 are slidably engaged with each other.

First, the inner surface of an outward sleeve member is allowed to contact only with the projecting ribs of an inward sleeve member and is prevented from directly contacting with the reflective material disposed on the outer surface of the inward sleeve member, so that the reflective material is protected from being scraped.

Second, the projecting ribs permit the inward sleeve member to closely contact with the inner surface of the outward sleeve member, whereby when the umbrella case is extended to an elongated state or retracted to a shortened state, the projecting ribs can enhance the tightness of fit between the respective sleeve members so that the umbrella case is prevented from unexpectedly shifting between the shortened state and elongated state. With respect to the top sleeve member 1, only a rear end thereof is formed with a stepped ring section 14 for engaging with the annular fixing groove 23. In addition, the surface of the umbrella case can be printed with fine figures to enhance the appearance thereof.

In conclusion, the telescopic safety umbrella case of the present invention not only possesses the conventional rainwater-collecting function but also includes a pressable water-draining valve, whereby a user only needs to press the water-draining valve against the ground for draining out the rain water collected in the umbrella case onto the ground. Therefore, the conventional shortcoming of splashing collected rain water onto others can be eliminated. In addition, the present umbrella case is directly molded from a reflective material or is painted with a layer of reflective paint or is attached with a reflective paper, so that the umbrella case is indicative of the user walking at night to ensure the safety of the user. Moreover, each of the sleeve members of the present umbrella case is provided with several projecting ribs, whereby the reflective material disposed on the outer surface of the sleeve member is protected from being scraped during frequent telescopic movement of the sleeve member. Therefore, the surface of the umbrella case can be printed with fine figures to enhance the appearance thereof and increase the attractivity to a consumer. Also, the projecting ribs can enhance the fitting tightness between the respective sleeve members so that the umbrella case is prevented from unexpectedly interchanging between the shortened state and elongated state.

The above preferred embodiments are only examples of the present invention and the scope of the present invention should not be limited to these examples. Any modification or variation derived from these examples should fall within the scope of the present invention.

What is claimed is:

1. An umbrella case comprising:

a) a top sleeve member including an outer wall provided with a water drain hole therein and an inner wall;

b) a valve means for opening and closing the drain hole;

c) a plurality of telescopically interfitted subsidiary sleeve members for collapsing together around the top sleeve member or extending outwardly therefrom to define a conical-shaped structure for receiving an umbrella therein, each subsidiary sleeve member including a front end and a rear end;

d) each front end including an inwardly directed annular flange section and an inwardly directed annular projection, the flange section being spaced from the projection to define an annular groove therebetween, and each rear end including an outwardly extending annular stepped section, the stepped section of each subsidiary sleeve member being engageable within the groove of an adjacent subsidiary sleeve member when the subsidiary sleeve members are extended outwardly from the top sleeve member; and e) each subsidiary sleeve member including an outer surface, a plurality of longitudinal ribs on the outer surface, each flange section being provided with a plurality of guide recesses, and the ribs being slideably engaged within the guide recesses for preventing the inner surface of each subsidiary sleeve member from contacting the outer surface of an adjacent subsidiary sleeve member during collapsing or extending of the subsidiary sleeve members.

2. The umbrella case of claim 1 wherein the valve means includes a valve body, a valve rod carried by the valve body and extending through the drain hole, and a spring biasing the valve body against the drain hole for closing same.

3. The umbrella case of claim 2 wherein the light reflective means includes reflective paint.

4. The umbrella case of claim 1 wherein the outer surface of each subsidiary sleeve member is provided with light reflective means thereon.

5. The umbrella case of claim 4 wherein the light reflective means includes reflective paper.

6. The umbrella case of claim 4 wherein the light reflective means includes reflective printing.

* * * * *